United States Patent [19]

DeSisto

[11] Patent Number: 4,527,960

[45] Date of Patent: Jul. 9, 1985

[54] BEARING AIR SEAL FOR VACUUM CLEANER MOTOR

[75] Inventor: Richard E. DeSisto, Carlisle, Pa.

[73] Assignee: General Signal Corporation, Stamford, Conn.

[21] Appl. No.: 576,667

[22] Filed: Feb. 3, 1984

[51] Int. Cl.[3] ..... F04B 39/06

[52] U.S. Cl. ..... 417/368; 417/423 A

[58] Field of Search ..... 417/368, 423 A

[56] References Cited

U.S. PATENT DOCUMENTS

| | | | |
|---|---|---|---|
| 2,031,911 | 2/1936 | Smellie | 417/423 A |
| 2,422,968 | 6/1947 | Jason | 417/423 A |
| 3,733,150 | 5/1973 | Porter et al. | 417/424 |
| 4,088,424 | 5/1978 | Hyatt et al. | 417/373 |
| 4,226,575 | 10/1980 | Hyatt et al. | 417/423 A |

*Primary Examiner*—Cornelius J. Husar
*Assistant Examiner*—Peter M. Cuomo
*Attorney, Agent, or Firm*—Ronald Reichman; Milton E. Kleinman; Perry Palan

[57] ABSTRACT

A combination motor-fan unit for wet pick-up vacuum cleaner applications is provided with a flow of sealing air past the bearing located between the motor and the fan. The housing supporting the bearing is provided with a diffusing chamber on the fan side of the bearing and a restricted air flow path through the housing to the diffusing chamber to utilize the motor cooling air as a source for the bearing sealing air. A check valve is provided in the restricted air flow path.

5 Claims, 4 Drawing Figures

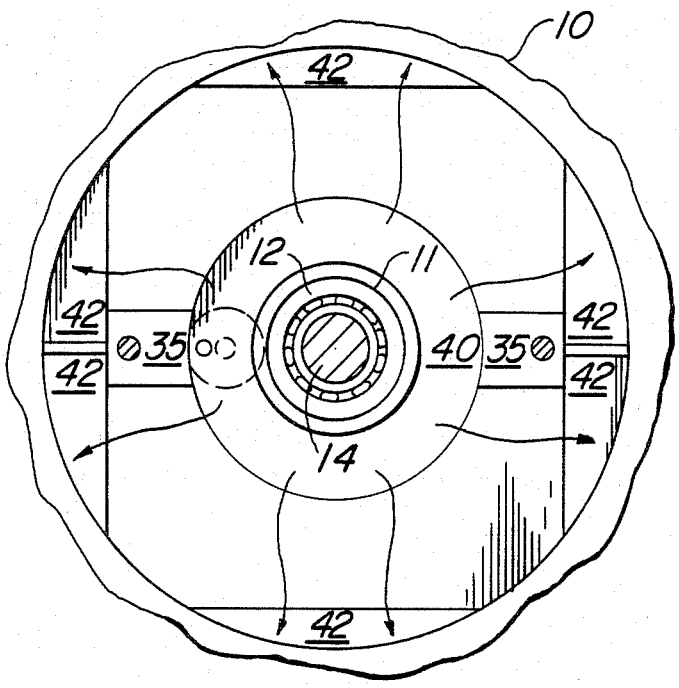
FIG. 2
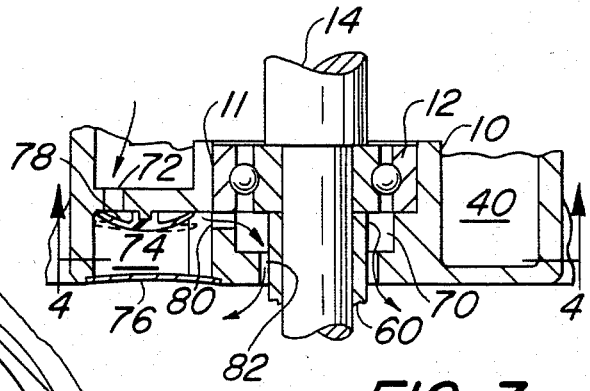
FIG. 3
FIG. 4
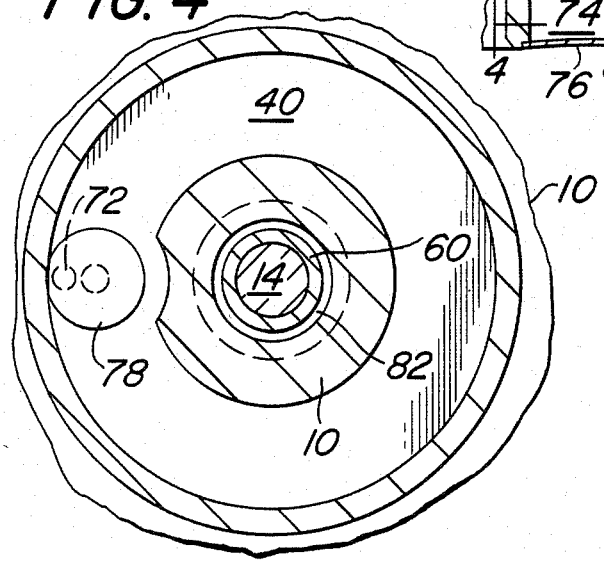

BEARING AIR SEAL FOR VACUUM CLEANER MOTOR

This invention relates to combination motor-fan units and particularly to such units for vacuum cleaners used with moisture burdened working air.

BACKGROUND OF THE INVENTION

Vacuum cleaner motor-fan combination units for use to pick up water or moisture burdened air are of the by-pass type wherein the working air drawn into the fan section of the unit is exhausted through a peripheral discharge which in larger units usually is in the form of a tangential scroll. Even though the moisture burdened working air flow is directed away from the bearing area of the motor, when such by-pass vacuum cleaners are used as water extraction cleaners for cleaning rugs, the vacuum cleaners are susceptible to premature bearing failure because a strong vortex action in the bearing area tends to draw some moisture or foam to the bearing. In such cleaning applications the moisture or foam usually contains a detergent that tends to wash the bearing lubricant out of the bearing and produce premature bearing failure.

In order to overcome the problem of premature bearing failure, prior art devices have introduced a flow of air from a separate air inlet at or near the periphery of the motor-fan housing through a flow path passing in the vicinity of the motor bearing and discharging into the working air flow path near the working air outlet. This flow of air is usually produced by an auxiliary fan located on, and driven by, the motor-fan shaft with the eye of the fan in the vicinity of the motor bearing. Other prior art has proposed that the entire flow of cooling air for the motor flow past the motor bearing and be discharged, with the working air, through a series of openings about the periphery of the fan section housing.

While the prior art arrangements have been effective in reducing premature bearing failure the use of peripheral air inlets has required that separate baffles must be used to separate the various air flow paths and the use of the full cooling air flow is not compatable with a reverse air flow check valve which provides protection in the event that the vacuum cleaner is tipped over or the working air outlet is blocked to prevent the normal outflow or working air. In the present invention a part of the conventional cooling air flowing past the motor flows through a small passageway in the central area of the motor housing to provide the sealing air to sweep any detergent carrying moisture or foam away from the bearing area and into the working air flow path near the working air outlet. The use of a part of the motor cooling air flow to provide the sealing air not only results in a more economical design and lower manufacturing costs, but also the cooling air fan assists the sealing air fan to provide the flow of sealing air.

SUMMARY OF THE INVENTION

It is an object of this invention to improve the sealing air flow around the bearing area of a motor-fan combination by using the motor cooling air as a source for the sealing air.

It is another object of this invention to provide an improved sealing air flow path in a motor-fan combination that is formed in a single molded housing.

Other and further objects and advantages of this invention will be apparent to those skilled in the art from the following detailed description of an embodiment of this invention, in which:

FIG. 2 is a sectioned plan view of the motor-fan unit with the section taken along line 2—2 of FIG. 1;

FIG. 3 is an enlarged partial sectional view of the motor bearing and the flow path for the sealing air; and FIG. 4 is a sectional view taken along line 4—4 of FIG. 3.

DETAILED DESCRIPTION OF THE DRAWINGS

Figure 1:
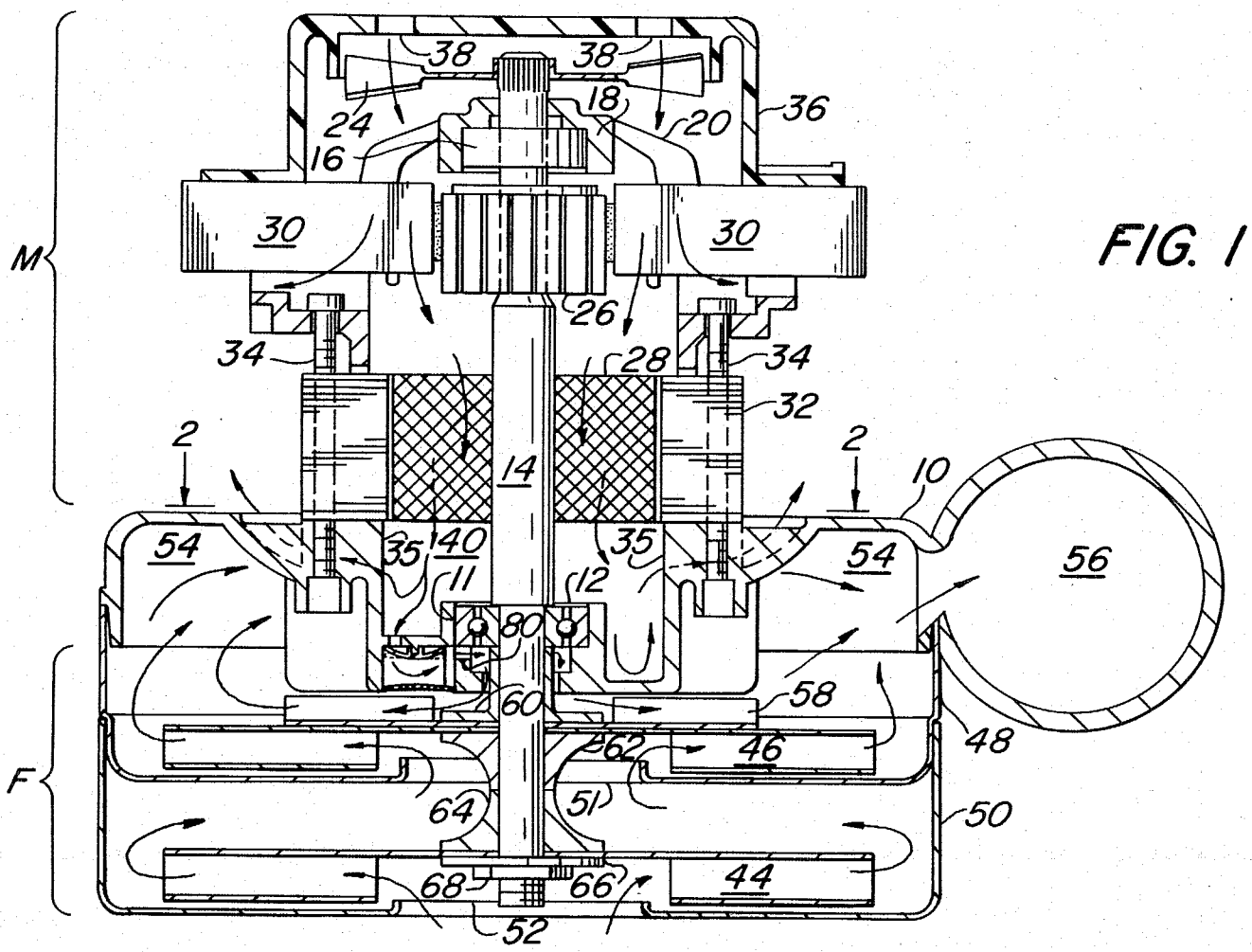
FIG. 1 is a sectional side elevation of a motor-fan unit incorporating the invention.

Referring now to FIG. 1, a housing member 10 serves to separate a motor section M of a motor-fan combination unit from a fan section F. While the housing member 10 may be made from any suitable material it has been found desirable to have the housing member molded from a thermosetting plastic material. In the center of the housing member 10 there is provided a bearing socket 11 into which is inserted a ball bearing 12 with the outer cage of the ball bearing 12 supported by the bearing socket 11. Journaled in the ball bearing 12 is a shaft 14 which extends through the motor section M and the fan section F.

Referring now to the motor section M in FIG. 1 the shaft 14 is supported at its upper end by another bearing 16 which may be of any conventional type. As shown in FIG. 1 the bearing 16 is a ball bearing which is secured in a bearing socket 18 carried by an end bracket 20. Secured to the end of the shaft 14 extending beyond the bearing socket 18 is a cooling fan 24 to provide a flow of cooling air to the motor section M. While the cooling fan 24 is shown secured as by a spline to the end of the shaft 14 it is to be understood that any conventional method may be used to secure the cooling fan 24 to the shaft 14.

The shaft 14 also carries a conventional commutator 26 and an armature 28. The end bracket 20 supports a pair of brush holders 30, 30, each supporting a brush for contact with the commutator 26. Surrounding the armature 28 are field laminations 32 which in conjunction with field coils, not shown, provide the necessary magnetic field for the motor section M. The housing member 10, end bracket 20, and field laminations 32 are secured together to form an integral motor units by bolts 34, 34. Referring to FIG. 1 and FIG. 2 when the bolts 34, 34 are tightened the field laminations 32 are supported by bosses 35, 35. This arrangement provides for flow of cooling air past the armature 28 and field laminations 32 into a chamber 40 formed in the housing 10 and out through openings 42 existing between the field laminations 32 and the housing 10.

The motor unit M is provided with an enclosing end cap 36 which may be supported by the brush holders 30, 30 and secured to them by way of spring clips, not shown, or by a suitable fastening device. The end cap 36 is provided with a series of openings 38 for entry of cooling air into the motor section M under the influence of the cooling fan 24. While not shown in the Figures the end cap 36 is provided with skirt portions that extend over the field laminations. Thus some of the cooling air flows out through the spaces under the brush holders 30, 30 while the main flow of the cooling air from the cooling fan 24 will be in a flow path past the armature 28 and field laminations 28 to provide adequate cooling for these motor parts.

The fan section F shown in FIG. 1 includes a two-stage design fan or pump to move the working air and additionally includes a sealing air fan to provide sealing air flow. The two-stage working air fan is composed of a first stage impeller 44 of conventional design and a second stage impeller 46. The impellers 44 and 46 are enclosed within a housing formed of two flat-bottomed cylindrical-walled drawn sheet metal shells 48 and 50. The shell 48 has its cylindrical wall fitted and secured to the outer periphery of the housing member 10 and an axial opening 51 in the center of its radial wall to provide for the flow of working air to the eye of the impeller 46. The shell 50 is telescoped onto a slightly reduced cylindrical end portion of the shell 48 and has in its flat-bottomed wall structure a central opening 52 for introducing working air to the eye of the impeller 44. The openings 51 and 52 in the flat-bottomed portion of the sheet metal shells 48 and 50 are each provided with up-standing lip portions to not only provide rigidity to sheet metal shells 48 and 50 but also to prevent recirculation of working air from the output of an associated impeller to the eye of that impeller. Thus, in operation the working air enters the fan section F at the opening 52 and follows a path including the first-stage impeller 44, the opening 51, the second stage impeller 51 into a circumferential chamber 54 formed in the housing member 10 and out of the fan section F by way of a tangential exhaust horn 56 molded into the housing member 10.

In addition to the impellers 44 and 46 in the fan section F for moving the working air through the fan section there is also included a sealing air impeller or fan 58 positioned in back to back relation with the impeller 46 for providing for the flow of bearing sealing air.

Conventionally the impellers 44, 46 and 58 are secured to and move with the shaft 14. As shown in FIG. 1 a spacer 60 is located on the shaft 14 with its upper end in contact with the inner race of the bearing 12. The spacer 60 has an enlarged head portion that contacts the wall of the impeller 58 to maintain the impeller 58 properly positioned within the fan section F. Additionally, a pair of spacers 62 and 64 are located between the impellers 44 and 46 for proper positioning of the impellers 44 and 46 in the fan section F. As shown, the outer surfaces of the spacers 62 and 64 are curvelinear in shape to enhance the flow of the working air from the output of the impeller 44 to the eye of the impeller 46. Additionally, although not shown, the space between the impeller 44 and the bottom of shell 48 may include vanes secured to the shell 48 to form a "stationary" fan. The impellers 44, 46, and 58 with the spacers 60, 62, and 64 are secured to the shaft 14 in conventional manner by a washer 66 and clamping nut 68 threaded onto the end of the shaft 14.

As previously explained, when the working air is laden with moisture or foam that includes a detergent such as is present in a vacuum cleaner used for cleaning of carpets and rugs, the flow of working air under the influence of the impeller creates a vortex near the shaft and moisture and foam with entrapped detergent accumulates at the motor bearing and washes the lubricant out of the bearing which results in early bearing failure. The above problem is overcome by this invention by providing adjacent to the fan side of the motor bearing 12 a diffusing chamber 70 (FIG. 3) molded in the housing 10. During operation the diffusing chamber 70 is continuously swept by a flow of bearing sealing air to remove any moisture that might otherwise accumulate in the chamber 70.

According to this invention the bearing sealing air is supplied from the cooling air flowing under the influence of the cooling fan 24 into the chamber 40 on the motor side of the housing 10. The housing 10 is provided with a small air passage hole 72 connecting the chamber 40 on the motor side of the housing 10 with a chamber 74 molded in the housing 10 and closed at one end by seal plate 76. The air passage hole 72 is provided with a check valve to prevent air from flowing from the fan side of the housing 10 to the motor side. In the embodiment shown the check valve is in the form of a pliable mushroom member 78 although it is to be understood that any other conventional check valve arrangement could be used.

The chamber 74 is connected by an air passage hole 80 to the diffusing chamber 70 for flow of bearing sealing air into the diffusing chamber 70. Bearing sealing air then flows out of the diffusing chamber 70 through an annular opening 82 (FIG. 4) between the spacer 60 and an axially located hole in the housing 10. The bearing sealing air then flows through the bearing sealing air impeller fan 58 and comingles in the chamber 54 with the working air from impeller 46 for discharge through the exhaust horn 56.

By utilizing the cooling air as a source of supply for the bearing sealing air the sealing air is moved through the bearing sealing air path not only by the bearing sealing air impeller or fan 58 but also by the cooling fan 24. The use of a part of the cooling air for bearing sealing also results in a less tortuous air flow path than prior art devices that require that the bearing sealing air be drawn from the out side of the unit. The presence of the diffusing chamber adjacent the fan side of the motor bearing not only enhances the sweeping action of the bearing sealing air, but also provides improved bearing cooling action by the bearing sealing air.

What is claimed is:

1. In a motor-fan combination unit having a motor section and a fan section separated by a housing having a motor side and a fan side;

a bearing supporting pocket having at least one air inlet for providing air flow and formed in said motor side of said housing;

a shaft bearing mounted in said bearing supporting pocket, a diffusing chamber formed in said housing with one wall of said diffusing chamber formed by said shaft bearing, so that said chamber will receive air from said inlet; and means for flowing motor cooling air from said motor side of said housing into said diffusing chamber and out said fan side of said housing;

whereby said air flowing through said diffusing chamber sweeps contaminating fluids on said fan side of said bearing out of said chamber to avoid contact of said bearing by said contaminating fluids.

2. Apparatus as claimed in claim 1 in which said means for flowing air through said diffusing chamber includes a restricted flow passage through said housing in close proximity to said bearing supporting pocket and a flow path into said diffusing chamber contained within said housing.

3. Apparatus as claimed in claim 2 in which said means for flowing air through said diffusing chamber includes a bearing sealing air fan mounted in said fan section.

4. Apparatus as claimed in claim 3 in which said restricted flow passage includes a check valve to prevent the reverse flow of air through diffusing chamber.

5. A motor-fan combination unit particularly suited for vacuum cleaner applications in which the working air of said vacuum cleaner may include detergent laden water or foam comprising:

a housing member disposed between the motor and the fan of said combination unit and including a tangential exhaust norm;

a bearing for said combination unit mounted between said motor and said fan and supported by said housing member;

a cooling air fan having an inlet for producing flow of cooling air over said motor;

a working air fan having an inlet and an outlet discharging into said tangential exhaust horn;

a working air fan cover sealingly attached to said housing member enclosing said working air fan and having a centrally located working air inlet port communicating with said inlet of said working air fan;

a sealing air fan, having an inlet and outlet, mounted in back-to-back relation with said working air fan with said outlet discharging into said tangential exhaust horn;

one or more air chambers contained within said housing, said air chambers receiving cooling air from said cooling air inlet;

a diffusing chamber located in said housing member and closed at one end by said bearing, so that said diffusing chamber receives air from said air chambers;

an air flow path passing through said housing to said diffusing chamber for passage of a part of said cooling air from said air chamber into said diffusing chamber at said bearing end; and an axial air outlet path from the end of said diffusing chamber opposite said bearing end to said inlet of said sealing air fan for movement of sealing air axially from said diffusing chamber and into said tangential exhaust horn.

* * * * *